United States Patent [19]

Cardwell et al.

[11] 3,944,070

[45] Mar. 16, 1976

[54] PALLET AND AN INTEGRAL PACKAGE UTILIZING THE PALLET

[75] Inventors: Charles G. Cardwell, Bartlesville, Okla.; Morris E. Speck, Akron, Ohio

[73] Assignee: Phillips Petroleum Company, Bartlesville, Okla.

[22] Filed: Sept. 9, 1974

[21] Appl. No.: 504,069

[52] U.S. Cl. ..... 206/386; 108/53; 206/497

[51] Int. Cl.[2] ..... B65D 19/00

[58] Field of Search ..... 206/386, 497; 108/53, 51; 229/DIG. 12; 217/43 A

[56] References Cited

UNITED STATES PATENTS

| | | | |
|---|---|---|---|
| 3,438,544 | 4/1969 | Cloyd | 206/386 |
| 3,611,952 | 10/1971 | Hoffman | 108/51 |
| 3,630,157 | 12/1971 | Ortenllad | 108/53 |
| 3,680,495 | 8/1972 | Pike | 108/53 |
| 3,776,435 | 12/1973 | Smith | 108/53 |
| 3,825,113 | 7/1974 | Kramer et al. | 206/386 |

*Primary Examiner*—George T. Hall

[57] ABSTRACT

A pallet is formed with a retention ledge extending outwardly from the upper portion of the pallet sidewall. A heat shrinkable sheath encompasses a plurality of articles and the top portion of the pallet including the retention ledge. A pallet cover can be placed on top of the stack before or after the sheath is thermally shrunk.

10 Claims, 8 Drawing Figures

PALLET AND AN INTEGRAL PACKAGE UTILIZING THE PALLET

This invention relates to a fork lift pallet and to an integral package utilizing the pallet and heat shrinkable film.

One of the difficulties encountered in moving a pallet loaded with a plurality of articles in two or more layers and in stacking such a loaded pallet on top of a similarly loaded pallet is the horizontal shifting of articles in the stack above the upper edge of the pallet. Heat shrinkable film can be employed to form a sheath about the stack of articles, but horizontal shifting can still occur due to slippage on the film along the surfaces of the pallet.

In accordance with the present invention, the pallet is provided with a retention flange extending outwardly from the upper extent of the sidewall of the pallet. This retention ledge maintains the position of the sheath with respect to the pallet while minimizing the possibilities of damage to the sheath by the fork lift.

Accordingly, it is an object of the present invention to provide a new and improved pallet. Another object of the invention is to stabilize a load of a plurality of articles on a pallet. A further object of the invention is to minimize damage to the sheath. Another object of the invention is to provide an anchoring ledge for a shrink film. Other objects, aspects and advantages of the invention will be apparent from a study of the specification, the drawings and the appended claims to the invention.

In the drawings, FIG. 1 is a top plan view of a fork lift pallet in accordance with one embodiment of the invention;

Figure 1:
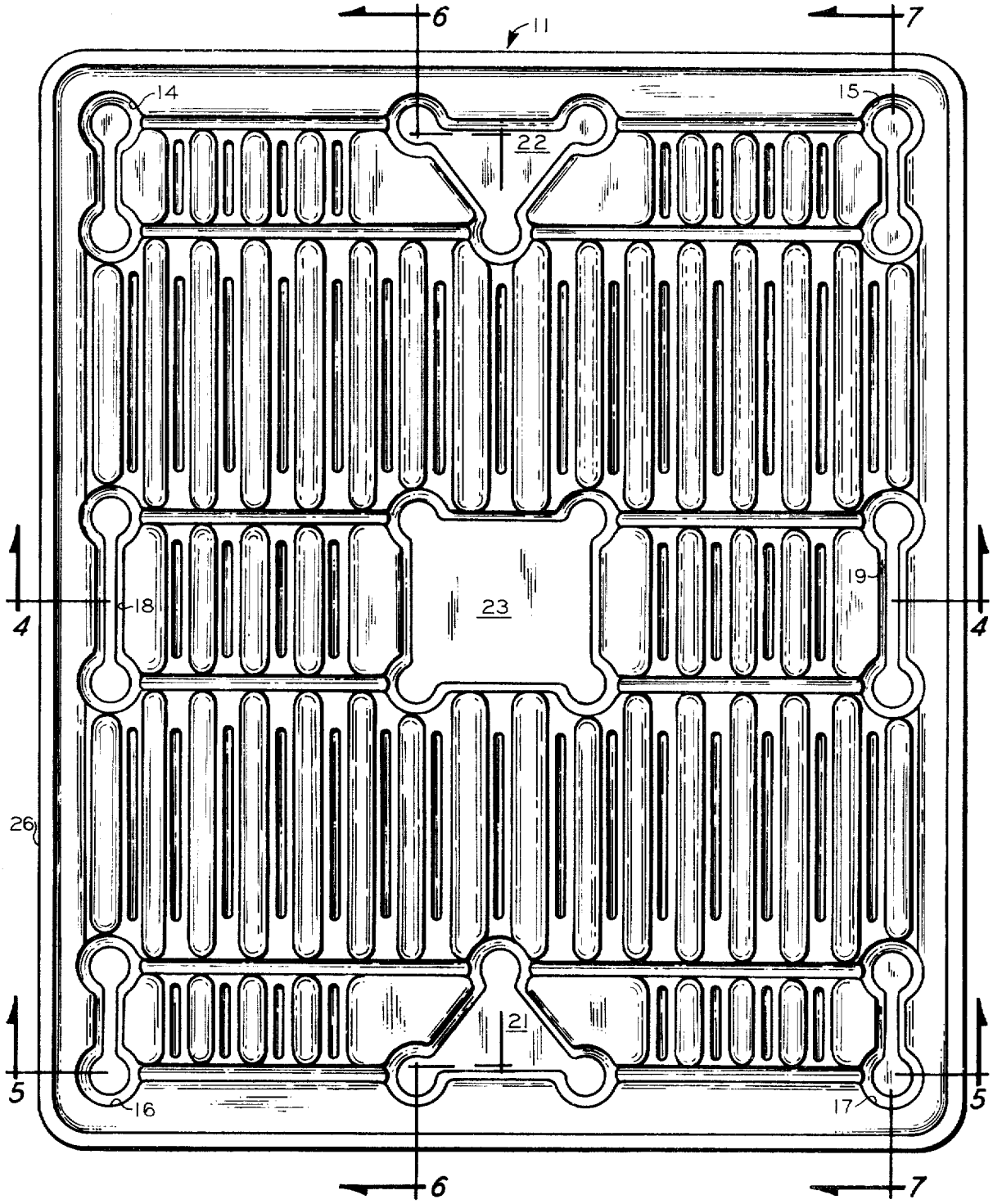
Figure 2:
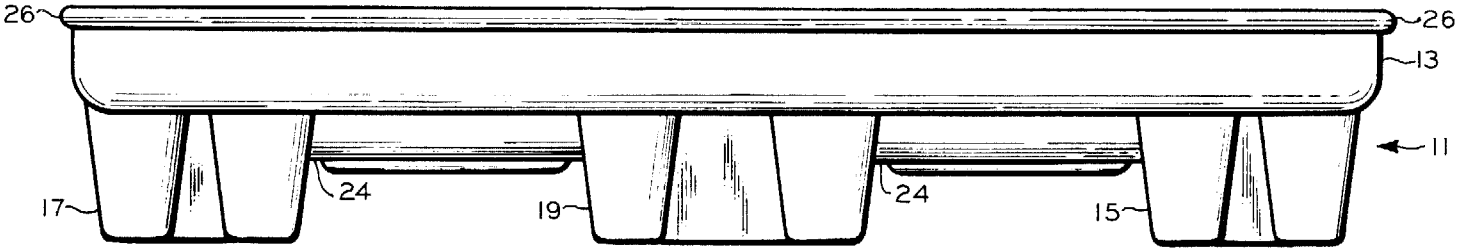
FIG. 2 is a side elevational view of the pallet of FIG. 1.
Figure 3:
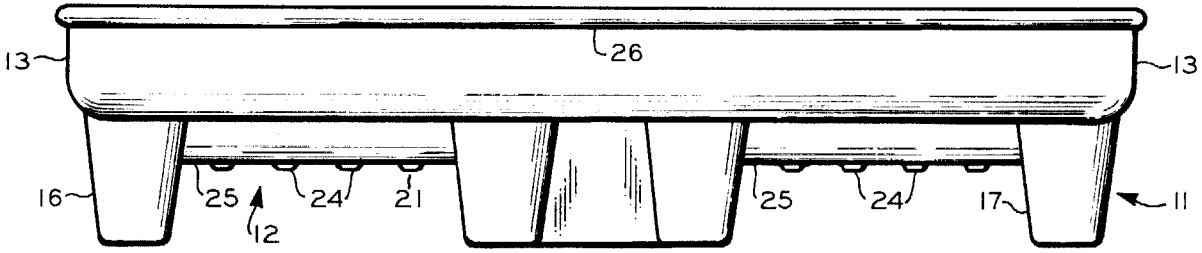
FIG. 3 is the front elevational view of the pallet of FIG. 1.
Figure 4:
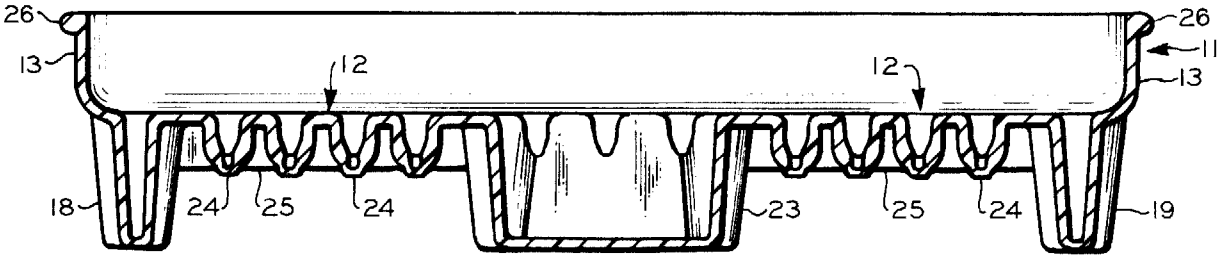
FIG. 4 is an elevational view in cross section taken along line 4—4 in FIG. 1.
Figure 5:
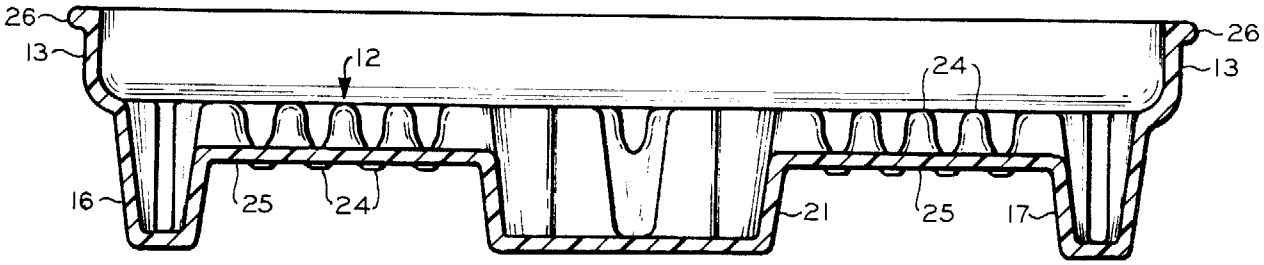
FIG. 5 is an elevational view in cross section taken along line 5—5 in FIG. 1.
Figure 6:
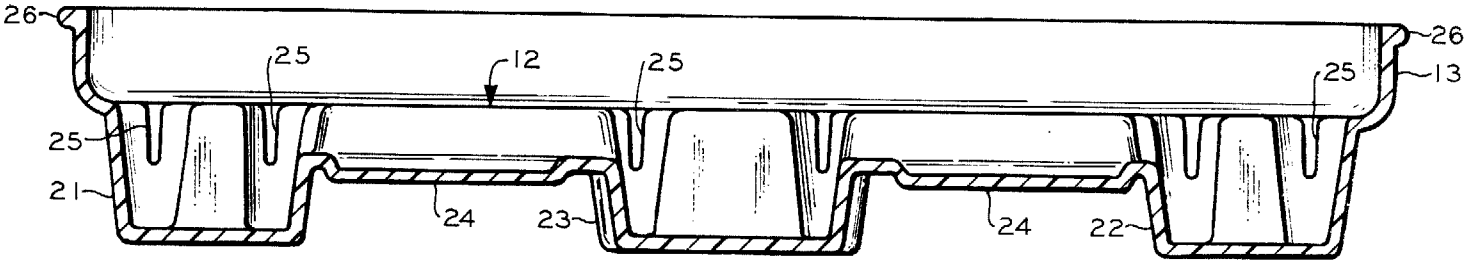
FIG. 6 is an elevational view in cross section taken along line 6—6 in FIG. 1.
Figure 7:
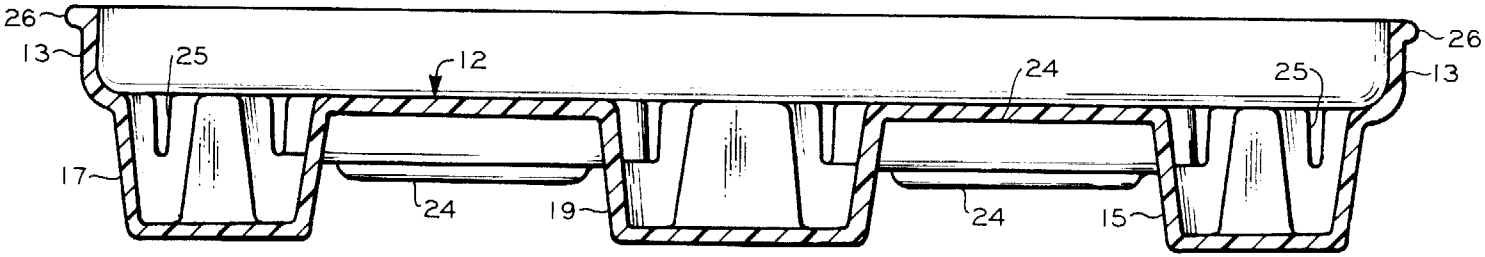
FIG. 7 is an elevational view in cross section taken along line 7—7 in FIG. 1.

Referring now to FIGS. 1-7, the pallet is a unitary structure comprising a generally rectangular bottom wall 12 and an upwardly extending continuous peripheral sidewall 13. The bottom wall 12 has a load supporting portion and a plurality of leg portions, with each leg portion having a support leg formed therein and extending downwardly below the load supporting portion. Corner legs 14, 15, 16 and 17 are located adjacent to corners of the bottom wall 12; side legs 18 and 19 are located on the sides in line with and midway between the respective pair of corner legs; front and back intermediate legs 21 and 22 are located on the front and back edges in line with and midway between the corner legs; and central leg 23 is located in line with and midway between legs 18 and 19 and in line with and midway between legs 21 and 22. Thus, the legs 14 to 19 and 21 to 23 are spaced to provide two passageways to accommodate the two tines of a conventional fork lift truck regardless of which side of pallet 11 is addressed by the truck. Each of legs 14 to 19 is in the form of a pair of hollow frustoconical columns interconnected by two walls, while each of legs 21 and 22 is in the form of three equally spaced hollow frustoconical columns joined by three walls, and central leg 23 is in the form of four equally spaced hollow frustoconical columns joined by four walls in a rectangular array. Bottom wall 12 is provided with a plurality of transverse corrugations or ribs 24 and a plurality of lateral corrugations or ribs 25 to increase the structural strength and rigidity of the pallet 11. A flange 26 extends horizontally outwardly from the upper extent of wall 13. While flange 26 can be discontinuous in the form of at least one projecting segment along each of the four sections of sidewall 13, it is presently preferred for flange 26 to extend continuously about the outer periphery of sidewall 13 in the form of a single, integral, uninterrupted outwardly projecting rib or lip. The flange can have uniform dimensions throughout its length or it can have variable dimensions, for example in the form of scallops or notches.

Figure 8:
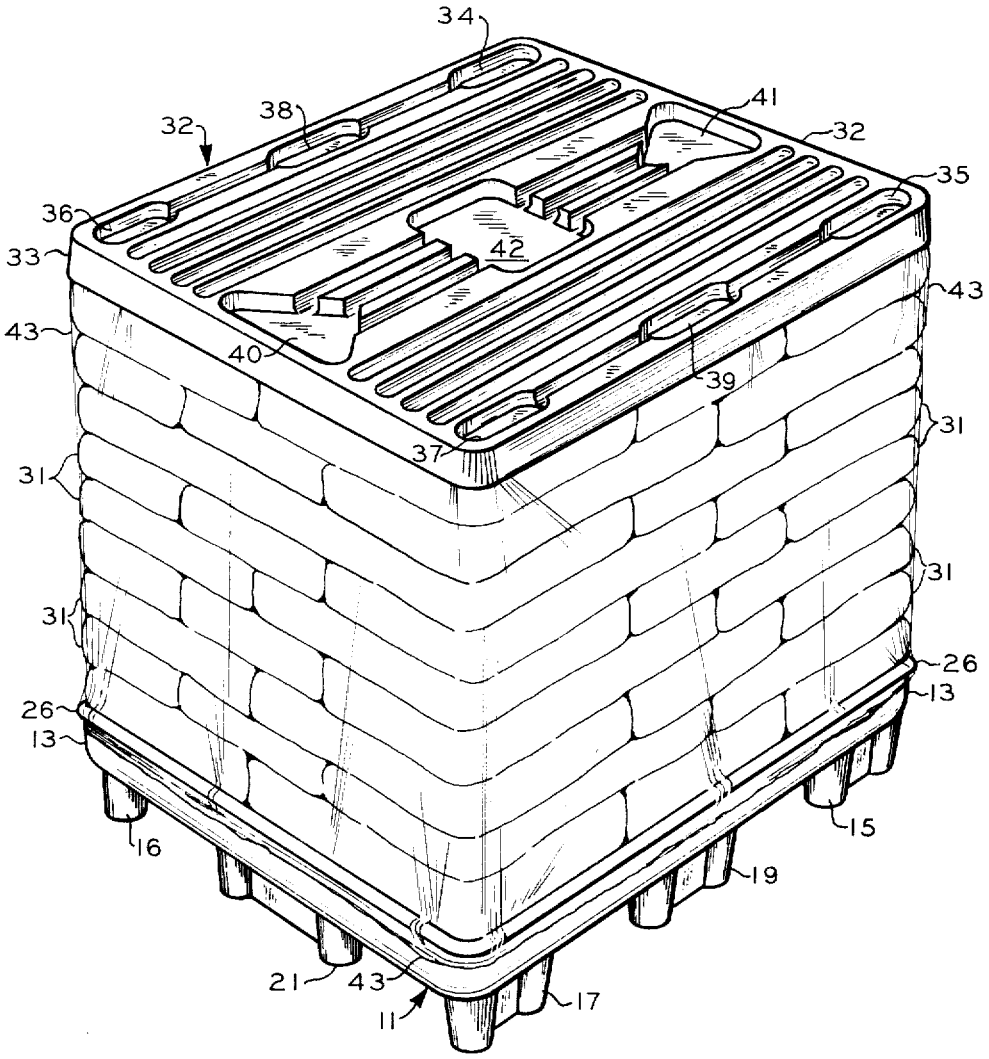
FIG. 8 is a perspective view of a palletized unit employing the pallet of FIG. 1.

Referring now to FIG. 8, a plurality of articles, such as bags 31, have been stacked in several layers on pallet 11. A pallet load cover 32 is positioned on top of the stack of bags 31. Pallet load cover 32 is provided with a downwardly extending peripheral flange 33 to at least partially contain and stabilize the bags 31 in the top layer against lateral movement with respect to one another. Pallet load cover 32 is provided with depressions 34 to 42 corresponding to the bottom portions of legs 14 to 19, 21, 22, and 23, respectively, so that a second loaded pallet 11 can be stacked on top of the pallet load cover 32 with the legs of the uppermost pallet nested in the depressions 34 to 42 of the pallet load cover 32. A layer of shrinkable thermoplastic film is wrapped about the loaded pallet and the ends thereof are overlapped and bonded to form a sheath 43. The sheath 43 can be formed before or after cover 32 is placed on the stack of articles. Sheath 43 has a sufficient vertical height so that after being heated to cause it to shrink and conform to the loaded pallet, it extends from a point below flange 26 on pallet 11 to at least the upper edge of the vertical sides of the stack of articles. The sheath 43 preferably extends above the stack of articles and then inwardly over at least the outer periphery of the top surface of the stack of articles. When cover 32 is placed on the stack before the sheath 43 is shrunk, the sheath 43 preferably extends to a point above the lowermost edge of the flange 33 of cover 32, more preferably to a point above the uppermost edge of flange 33, thereby making the pallet 11, bags 31, pallet load cover 32 and sheath 43 a unitary package. Flange 26 can have s smoothly curved vertical contour to minimize the possibility of rupturing sheath 43. Positioning the flange 26 at the upper extent of sidewall 13 minimizes the possibility of damage to sheath 43 during the insertion and withdrawal of the tines of the fork lift. While the lower portion of sheath 43 can extend below flange 26, it is desirable that the lower edge of sheath 43 be above the bottom edge of sidewall 13 to avoid contact with the fork lift tines.

Each of pallet 11 and pallet load cover 32 can be formed by suitable techniques, for example by vacuum forming a single sheet of thermoplastic material or by rotational molding. Any suitable thermoplastic material can be employed to form pallet 11 and pallet load cover 32, but the normally solid polyolefins and the normally solid polyamides are preferred. Examples of suitable thermoplastic materials include polyethylene, polypropylene, copolymers of ethylene as described hereinafter, nylon 6,6, nylon 6, nylon 11, and blends thereof. It will generally be desirable to incorporate a suitable reinforcing agent, for example glass fibers, to increase the strength and rigidity of the formed articles. In a presently preferred embodiment, pallet 11 and pallet load cover 32 are rotationally molded from a polymer of ethylene, that is, an ethylene homopolymer, a copolymer of ethylene and at least one acyclic straight or branched chain mono-1-olefin hydrocarbon having 3 to 8 carbon atoms per molecule, or a mixture of such homopolymers, of such copolymers, or of at least one such homopolymer and at least one such copolymer; having incorporated therein a suitable crosslinking compound. A presently preferred group of such hydrocarbon comonomers are the straight chain hydrocarbons, particularly those straight chain hydrocarbons having 3 to 6 carbon atoms per molecule. The copolymers are usually formed with ethylene constituting at least 75 weight percent of the total monomers. Excellent results are obtained with copolymers of ethylene and 1-butene, wherein ethylene constitutes at least 75 weight percent of the total monomers. Other polymers of ethylene include, for example, copolymers of ethylene and propylene, copolymers of ethylene and isobutene, copolymers of ethylene and 1-pentene, copolymers of ethylene and 3-methyl-1-butene, copolymers of ethylene and 1-hexene, copolymers of ethylene and 4-methyl-1-pentene, copolymers of ethylene and 1-heptene, copolymers of ethylene and 1-octene, and copolymers of ethylene and 4-ethyl-1-hexene.

In general, the uncrosslinked polymer of ethylene employed will have a melt index of at least about 10, a density in the range of about 0.92 to about 0.97, preferably in the range of about 0.940 to about 0.965, gram per cubic centimeter. Uncrosslinked polymers having a melt index (ASTM D 1238-70, Cond. E.) in the range of about 10 to about 200 give excellent results, with the polymers having a melt index in the range of about 10 to about 50 being presently preferred. The polymers can be produced by any suitable method and can be selected from among those commercially available where desired.

Suitable crosslinking compounds include the acetylenic diperoxy compounds, which includes the hexynes having the formula

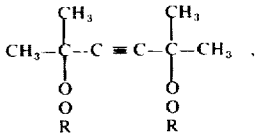

octynes having the formula

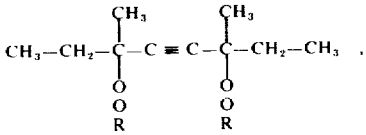

and octadiynes having the formula

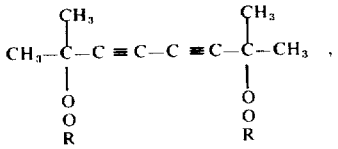

wherein R is selected from the group consisting of tertiary alkyl, alkoxycarbonyl, and benzoyl. In general, the molecular weights of the polyperoxides fall within the range of about 230 to about 550. Excellent results are received with the above-noted hexynes. Among the compounds encompassed within the above-noted hexynes, octynes, and octadiynes are:

2,7-Dimethyl-2,7-di(t-butylperoxy)octadiyne-3,5

2,7-Dimethyl-2,7-di(peroxy ethyl carbonate)octadiyne-3,5

3,6-Dimethyl-3,6-di(peroxy ethyl carbonate)-octyne-4

3,6-Dimethyl-3,6-(t-butylperoxy)octyne-4

2,5-Dimethyl-2,5-di(peroxybenzoate)hexyne-3

2,5-Dimethyl-2,5-di(peroxy-n-propyl carbonate)-hexyne-3

2,5-Dimethyl-2,5-di(peroxy ethyl carbonate)-hexyne-3

2,5-Dimethyl-2,5-di(alpha-cumyl peroxy)hexyne-3

2,5-Dimethyl-2,5-di(peroxy beta-chloroethyl carbonate)hexyne-3

2,5-Dimethyl-2,5-di(t-butylperoxy)hexyne-3.

The crosslinking agent is preferably incorporated within the particles of the molding composition utilized to form the pallet or pallet load cover 32 rather than being dry blended with particles of polymer. When dry blending of the polymer particles and the crosslinking agent is employed, there is a very severe problem of voids in the wall of the molded article formed from such dry blended material. Any suitable amount of crosslinking agent can be incorporated into the molding composition, as the amount employed can depend upon the specific crosslinking agent as well as the degree of crosslinking desired. In general the amount of the crosslinking agent will be in the range of about 0.1 to about 10, preferably in the range of about 0.5 to about 3, parts by weight per 100 parts by weight of the polymer of ethylene or other crosslinkable polymer.

The thermally shrinkable film utilized to form the sheath 43 can be formed in any suitable manner known in the art. the shrinkable film can be polyester, polyethylene, polypropylene, polystyrene, poly(vinyl chloride), vinylidene chloride copolymer, or any other suitable thermoplastic material, but is preferably polyethylene. The shrinkable film is preferably biaxially oriented to provide shrinkage in both horizontal and vertical directions. The thickness of the film can vary with the polymer, the type of articles being packaged, and the size of the loaded pallet, but will generally be in the range of about 0.5 to about 20 mils, and preferably will be in the range of about 2 to 15 mils, and more preferably will be in the range of about 4 to about 10 mils.

Reasonable variations and modifications are possible within the scope of the foregoing disclosure, the drawings and the appended claims to the invention.

That which is claimed is:

1. A fork lift pallet having a generally rectangular bottom wall, a continuous sidewall extending upwardly from the outer periphery of said bottom wall, said bottom wall having a load supporting portion and a plurality of leg portions, each leg portion having a hollow support leg formed therein and extending downwardly below said load supporting portion, said support legs being arranged in at least two spaced rows at least generally parallel to two opposed sides of said bottom wall to permit the entry of the tines of a fork lift between adjacent legs from any side of the pallet, a retention ledge extending outwardly from the upper end of said sidewall to provide a horizontal lip at the upper extremity of the pallet.

2. A pallet in accordance with claim 1 wherein said retention ledge extends horizontally outwardly continuously around the periphery of said sidewall to form an uninterrupted lip.

3. A pallet in accordance with claim 2 wherein said pallet is a onepiece molded article, and wherein said lip has a smoothly curved vertical contour.

4. A package comprising a fork lift pallet in accordance with claim 1 and further comprising a plurality of articles stacked on said load supporting portion, and a thermally shrunken sheath of a heat shrinkable thermoplastic film encompassing at least the upper portion of said sidewall and the outer periphery of the stack of said plurality of articles, said film extending generally vertically upwardly from a point below said retention ledge to at least the upper edge of the vertical sides of said stack of articles, thereby securing together said pallet and said plurality of articles.

5. A package comprising a fork lift pallet having a bottom wall and a continuous sidewall extending upwardly from the outer periphery of said bottom wall, said bottom wall having a load supporting portion and a plurality of leg portions, each leg portion having a support leg formed therein and extending downwardly below said load supporting portion, a retention ledge extending outwardly from said sidewall, a plurality of articles stacked on said load supporting portion, and a thermally shrunken sheath of a heat shrinkable thermoplastic film encompassing at least the upper portion of said sidewall and the outer periphery of the stack of said plurality of articles, said film extending generally vertically upwardly from a point below said retention ledge to at least the upper edge of the vertical sides of said stack of articles, thereby securing together said pallet and said plurality of articles.

6. A package in accordance with claim 5 wherein said retention ledge extends horizontally outwardly continuously around the periphery of said sidewall.

7. A package in accordance with claim 6 wherein said retention ledge has a smoothly curved vertical contour.

8. A package in accordance with claim 7 wherein said retention ledge extends generally horizontally outwardly from the uppermost extent of said sidewall.

9. A package in accordance with claim 8 wherein said sheath extends above the upper edge of the vertical sides of said stack of articles and then inwardly over at least the outer peripheral portion of the top surface of said stack of articles.

10. A package in accordance with claim 9 further comprising a pallet load cover having a top wall positioned on top on said stack of articles and the portion of said sheath extending inwardly over at least the peripheral portion of the top surface of said stack of articles, said cover having a continuous flange extending downwardly from the outer periphery of said top wall to encompass the top portion of the vertical sides of said stack of articles.

* * * * *